US008185998B2

(12) United States Patent
Xu

(10) Patent No.: US 8,185,998 B2
(45) Date of Patent: May 29, 2012

(54) COSMETIC BRUSHES

(75) Inventor: Hong Lian Xu, Tianjin (CN)

(73) Assignee: Anisa International, Inc., Atlanta, GA (US)

( * ) Notice: Subject to any disclaimer, the term of this patent is extended or adjusted under 35 U.S.C. 154(b) by 0 days.

(21) Appl. No.: 12/726,797

(22) Filed: Mar. 18, 2010

(65) Prior Publication Data

US 2010/0236004 A1 Sep. 23, 2010

Related U.S. Application Data

(60) Provisional application No. 61/210,508, filed on Mar. 19, 2009.

(51) Int. Cl.
*A46B 7/04* (2006.01)

(52) U.S. Cl. ..... 15/106; 15/172; 15/176.1; 15/202; 132/120; 132/313

(58) Field of Classification Search ..... 15/106, 15/176.1, 172, 194, 202, 203; 132/120, 313
See application file for complete search history.

(56) References Cited

U.S. PATENT DOCUMENTS

| | | | | |
|---|---|---|---|---|
| 1,307,837 | A * | 6/1919 | Stanecky | 15/203 |
| 1,608,400 | A * | 11/1926 | Kraft | 15/203 |
| 2,648,082 | A * | 8/1953 | Teetsel | 15/106 |
| 2,697,642 | A | 12/1954 | Rudy | |
| 2,725,038 | A | 11/1955 | Owen | |
| 2,866,993 | A | 1/1959 | Edelstone | |
| 3,363,775 | A | 1/1968 | Shaw | |
| 4,927,281 | A | 5/1990 | Gueret | |
| 5,063,947 | A | 11/1991 | Gueret | |
| 5,107,984 | A | 4/1992 | Welschoff | |
| 5,165,760 | A | 11/1992 | Gueret | |
| 5,339,483 | A | 8/1994 | Byun | |
| 5,482,059 | A | 1/1996 | Miraglia | |
| 5,778,479 | A * | 7/1998 | Raia | 15/202 |
| 6,035,865 | A | 3/2000 | Krieger | |
| 6,070,597 | A | 6/2000 | Motherhead | |
| 6,189,697 | B1 | 2/2001 | Davis | |

(Continued)

FOREIGN PATENT DOCUMENTS

| | | |
|---|---|---|
| CN | 201067174 | 6/2008 |

(Continued)

OTHER PUBLICATIONS

International Search and Written Opinion dated Mar. 26, 2010, PCT Application No. PCT/US2009/004143.

(Continued)

*Primary Examiner* — Mark Spisich
(74) *Attorney, Agent, or Firm* — Alston & Bird LLP

(57) ABSTRACT

A half-moon brush or other cosmetic applicator is in two parts, each having a head and a flat handle. The handle of each part has a wide major face and a narrow side face. The two parts are combined in a first configuration with the two narrow side faces abutting and the heads side by side to form a single wide, flat head, and are combined in a second configuration with the two wide major faces abutting and the heads face to face to form a single thicker, less wide, flat head. Each of the parts of the applicator has magnetic components that cooperate with magnetic components in the other part to hold the applicator parts together in both the first and the second configurations.

10 Claims, 5 Drawing Sheets

U.S. PATENT DOCUMENTS

| | | | | |
|---|---|---|---|---|
| 6,283,298 | B1 | 9/2001 | Seidler | |
| 6,532,970 | B2 | 3/2003 | Phue | |
| 6,546,937 | B2 | 4/2003 | Gueret | |
| 6,588,958 | B1 | 7/2003 | Seidler | |
| 6,591,842 | B2 | 7/2003 | Gueret | |
| 6,669,389 | B2 | 12/2003 | Gueret | |
| 6,681,936 | B2 | 1/2004 | Godshaw et al. | |
| 6,831,541 | B1 | 12/2004 | Seidler | |
| 6,866,046 | B2 | 3/2005 | Gueret | |
| 6,926,151 | B1 | 8/2005 | Perry et al. | |
| 6,974,513 | B2 | 12/2005 | Kepka | |
| 2001/0037815 | A1 | 11/2001 | Gueret | |
| 2002/0117423 | A1 | 8/2002 | Jackson | |
| 2004/0018037 | A1 | 1/2004 | Gueret | |
| 2004/0168700 | A1 | 9/2004 | Dorf | |
| 2005/0031401 | A1 | 2/2005 | Gueret | |
| 2005/0224392 | A1 | 10/2005 | Perry et al. | |
| 2007/0014624 | A1 | 1/2007 | Fogelson et al. | |
| 2007/0199575 | A1 | 8/2007 | Del Ponte | |
| 2008/0263798 | A1* | 10/2008 | Belmonte | 15/106 |
| 2008/0283083 | A1 | 11/2008 | Piao et al. | |
| 2010/0017990 | A1 | 1/2010 | Piao et al. | |

FOREIGN PATENT DOCUMENTS

| | | |
|---|---|---|
| EP | 1050235 | 11/2000 |
| JP | 57-018414 | 1/1982 |
| JP | 2003-033228 | 2/2003 |
| KR | 20-0393906 | 8/2005 |
| KR | 20-0404018 | 12/2005 |
| KR | 20-0406850 | 1/2006 |
| KR | 20-0408108 | 2/2006 |
| KR | 20-0432010 | 11/2006 |
| WO | WO 2009/054918 | 4/2009 |
| WO | WO 2010011273 | 1/2010 |

OTHER PUBLICATIONS

Office Action dated Apr. 5, 2010, U.S. Appl. No. 11/975,808.

International Search Report and Written Opinion dated Mar. 26, 2009, Application No. PCT/US2008/011883.

Office Action dated Mar. 24, 2010, U.S. Appl. No. 11/702,475.

International Search Report and Written Opinion dated Oct. 29, 2010, PCT Application No. PCT/US2010/027798.

* cited by examiner

COSMETIC BRUSHES

CROSS REFERENCE TO RELATED APPLICATIONS

This application claims the benefit of U.S. Provisional Patent Application No. 61/210,508, filed on Mar. 19, 2009, which is incorporated herein by reference in its entirety.

BACKGROUND OF THE INVENTION

The application of makeup requires the even distribution of cosmetics. To obtain a natural-looking application, while achieving the desired enhanced appearance of the wearer's eyes, cheek or face, the cosmetics are often applied using a variety of cosmetic brushes or applicators, each having a specific cosmetic application. Makeup can also be used to camouflage or hide certain undesired colors, blemishes, birthmarks, scars, or disfigurations on the face.

Cosmetics are often applied to the face by a brush or other applicator. Cosmetic brushes comprise a variety of sizes and shapes, wherein each brush is designed for a specific application or area of the face. One type of brush used is a "half-moon" brush, which is flat in shape, with a head of parallel bristles typically an inch to an inch and a half (25 to 40 mm) wide and a quarter of an inch (6 mm) or less thick. The name "half-moon" arises because the tip edge of the head may be convex, giving the head a D shape. The handle is typically rectangular, and similar in size to the head, though for practical reasons rather thicker.

Although convenient for applying a dusting of powder to a large area of the face, the "half-moon" brush is not compact in shape, and thus not easy to store.

Thus, it is apparent that there has been, prior to the present invention, an unfulfilled need for an improved cosmetic brush.

SUMMARY OF THE INVENTION

An object of one embodiment of the present invention is to provide cosmetic brushes that combine the broad, thin head of a half-moon brush with a compact shape for storage.

An object of one embodiment of the present invention is to provide a brush comprising two parts, each having a flat head and a flat handle. The handle of each part has a wide major face and a narrow side face. The two parts can be placed together in a first configuration with the two narrow side faces abutting and the heads parallel and side by side to form a single wide, flat head. The two parts can be placed together in a second configuration with the two wide major faces abutting and the heads face to face to form a single wide, flat head. Each part has magnetic components that cooperate with magnetic components in the other part to hold the brush parts together in both the first and the second configurations.

In an embodiment, the wide major faces and the narrow side faces may be flat, and the two parts may be held together substantially solely by magnetic attraction and friction. In an alternative embodiment, the narrow side faces may be formed with at least one mating projection and recess. In a further alternative embodiment, the wide major faces may be formed with at least one mating projection and recess.

In an embodiment, the magnetic components may all be permanent magnets. In an alternative embodiment, some of the magnetic components may be magnetically soft ferromagnetic material cooperating with permanent magnets.

Each of the narrow side faces may be provided with two or more magnetic components spaced apart along the length of the narrow side faces. The permanent magnets among the magnetic components may then be oriented with one pole facing out through the associated narrow side face. The magnetic components may be spaced along the center of the respective narrow side face. The two brush parts then typically have different configurations of magnetic components. A narrow side face with magnetic components may be provided on both sides of each brush part. However, if the two sides are different, for example, if each brush part is one half of a "half-moon" brush so that the bristles are longer at the sides intended to be the middle of the "half-moon," then a narrow side face with magnetic components may be provided on only the side of each brush part intended to be at the middle of the assembled wide brush.

Each of the wide major faces may be provided with two or more magnetic components spaced apart along the length and/or across the width of the wide major faces. The permanent magnets among the magnetic components may then be oriented with one pole facing out through the associated wide major face. A wide major face with magnetic components may be provided on only one face of each brush part. The other face may then be provided with decoration and/or information intended to be visible in the second configuration of the brush. A wide major face with magnetic components may be provided on both faces of each brush part. The magnetic components may then extend through the thickness of the brush part handle. If all of the magnetic components are permanent magnets, and the two brush parts are placed in the second configuration with the side of each brush part intended to be at the middle of the assembled wide brush adjacent, the arrangement of the magnets associated with the wide major faces may then be identical for both brush parts.

Additional features, objects and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain certain principles of the invention. However, the detailed description accompanying each Figure is not intended to limit the scope of the claims appended hereto.

DETAILED DESCRIPTION OF CERTAIN EMBODIMENTS

Reference will now be made in detail to preferred and alternative embodiments of the present invention, examples of which are illustrated in the accompanying drawings. Like elements have the same numbers throughout the several views. However, techniques, systems and operating structures in accordance with the present invention may be embodied in a wide variety of sizes, shapes, forms and modes, some of which may be quite different from those in the disclosed embodiment. Consequently, the specific structural and functional details disclosed herein are merely representative; yet in that regard, they provide a basis for the claims herein which define the scope of the present invention. Although the illustrated embodiments are merely exemplary of systems for carrying out the present invention, both the organization and method of operation of the invention, in general, together with further objectives and advantages thereof, may be more easily understood by reference to the drawings and the following description.

Figure 1:
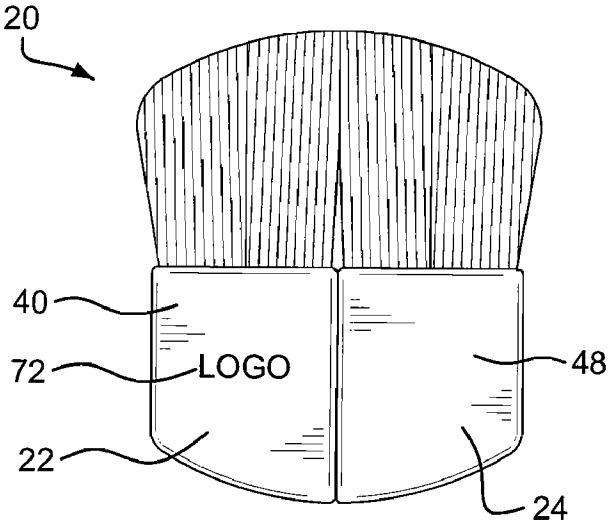
FIG. 1 is a front view of a first embodiment of a cosmetic brush, in an "open" configuration.

Referring to the drawings, and initially to FIG. 1, a first form of cosmetic brush, indicated generally by the reference numeral 20, may be of any size, shape or material without limitation. Cosmetic brush 20 comprises two halves 22 (see especially FIGS. 6, 7, and 10 through 12) and 24 (see especially FIGS. 8, 9, and 13 through 15). The two halves 22, 24 are very similar, and in the interests of conciseness, description of the common features will largely not be repeated. The few differences between the two halves 22, 24 are explained in the description below. Brush halves 22, 24 each have a head 26, comprising hairs, bristles or fibers, and a magnet holder 28, shown separately in FIGS. 16 through 18, received in respective casings 30, 32, which also act as handles, shown separately in FIGS. 10 through 12 and 13 through 15.

Figure 15:
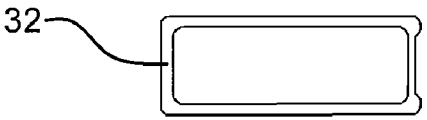
FIG. 15 is a top view of the casing shown in FIG. 10.
Figure 13:
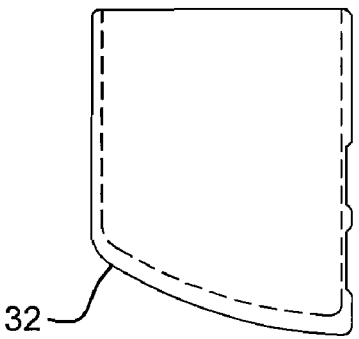
FIG. 13 is a front view of a casing forming part of the half brush shown in FIG. 8.
Figure 11:
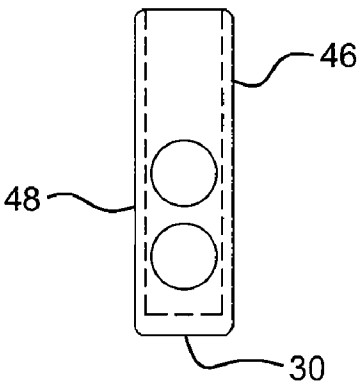
FIG. 11 is a side view of the casing shown in FIG. 10.
Figure 12:
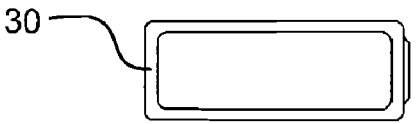
FIG. 12 is a top view of the casing shown in FIG. 10.
Figure 10:
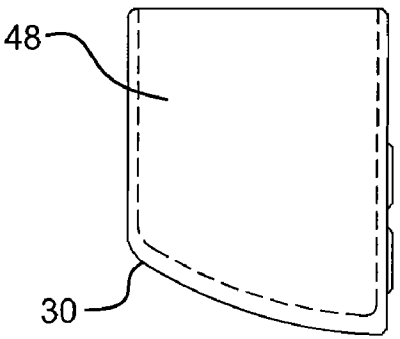
FIG. 10 is a front view of a casing forming part of the half brush shown in FIG. 6.

As best seen in FIGS. 12 and 15, in this embodiment each of the casings 30, 32 is rectangular in plan view, and is open at the top. The magnet holder 28 is shaped to fit snugly within the casing 30 or 32, leaving an empty space at the open top end 34 of the casing 30, 32. The basal ends 36 of the bristles, hairs, or other elements forming the heads 26 are placed in the open top ends 34 of the casings 30, 32, which thus act as ferrules to hold the heads 26. The bristles, hairs, or other elements forming the heads 26 may be fixed in place in a convenient way, including ways already known, including by glue or other material that adheres to the inside of the casings 30, 32, which also secures the magnet holder 28 in position in the casing 30, 32.

Figure 4:
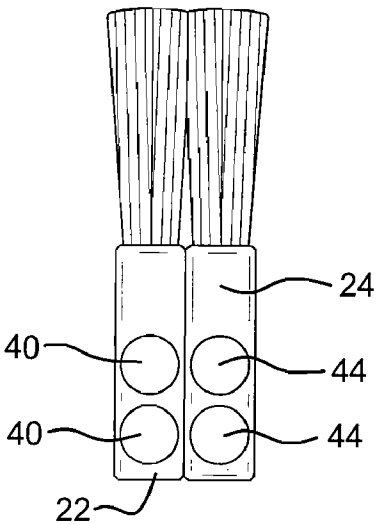
FIG. 4 is a side view of the brush as shown in FIG. 3.
Figure 3:
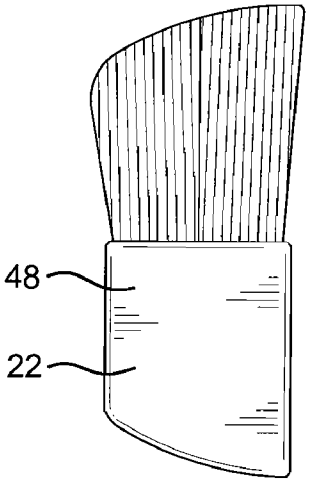
FIG. 3 is a front view of the brush shown in FIG. 1, in a "folded" configuration.
Figure 5:
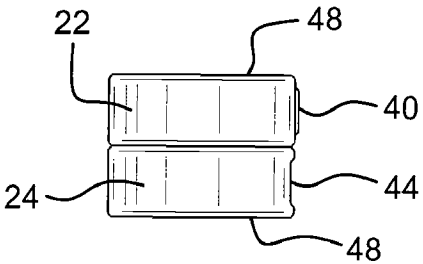
FIG. 5 is a bottom view of the brush as shown in FIG. 3.
Figure 2:
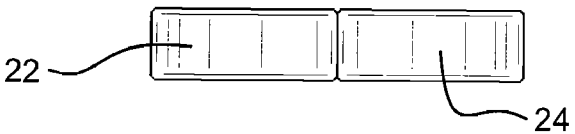
FIG. 2 is a bottom view of the brush as shown in FIG. 1.
Figure 8:
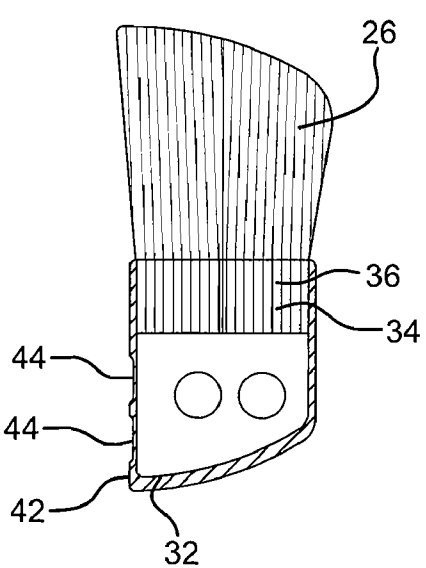
FIG. 8 is a sectional front view of the other half of the cosmetic brush shown in FIG. 1.
Figure 9:
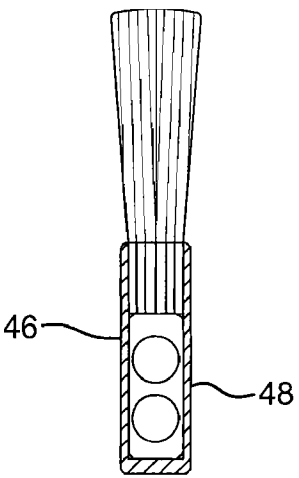
FIG. 9 is a sectional side view of the half brush shown in FIG. 8.
Figure 7:
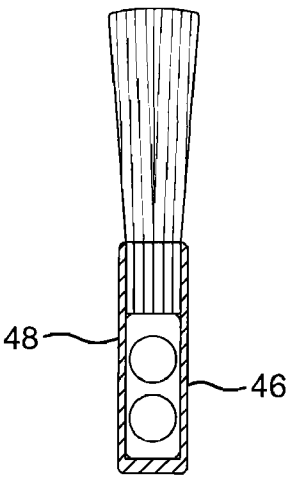
FIG. 7 is a sectional side view of the half brush shown in FIG. 6.
Figure 6:
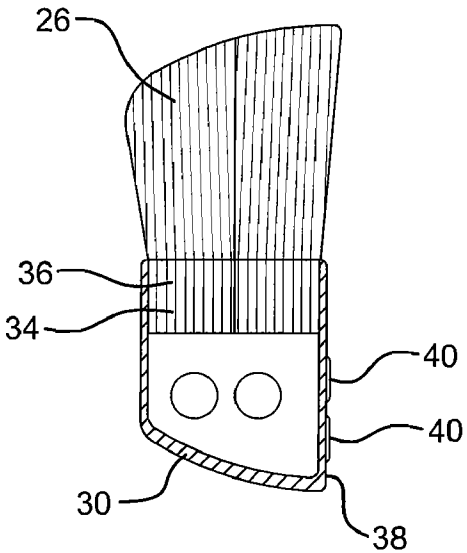
FIG. 6 is a sectional front view of one half of the cosmetic brush shown in FIG. 1.

In the embodiment shown in FIGS. 1 through 18 of the drawings, one narrow side face 38 of the casing 30 of the brush half 22 is flat and smooth except for two circular projections 40. The matching narrow side face 42 of the casing 32 of other brush half 24 has two matching circular recesses 44. The two brush halves 22, 24 are placed with the matching narrow side faces 38, 42 abutting, and the projections 40 seated in the recesses 44, to form the assembled brush 20 in the first or open configuration as shown in FIGS. 1 and 2. One wide major face 46 of each of the casings 30, 32 is flat and smooth, and is placed against the matching wide major face 46 of the casing 32, 30 of the other brush half 24, 22 to form a narrower, thicker second or folded configuration of the assembled brush 20, as shown in FIGS. 3 through 5, that may be used when storing the brush. As may be seen from the drawings, the "wide" faces are wider than the "narrow" faces, and in a half-moon brush typically two or three times as wide.

As shown in the drawings, only one narrow side of each brush half 22, 24 is used as the narrow side face 38, 42 that mates with the other brush half 24, 22 in the open configuration shown in FIGS. 1 and 2. Both the heads 26 and the casings 30, 32 are curved so that in the open configuration they form rounded shapes, giving the tip edge of the combined heads 26 a convex "half-moon" shape and the bottom of the combined casings 30, 32 a convex shape that both echoes the "half-moon" shape of the tips visually, and is comfortable to hold. Because of the shaping, it is immediately apparent to the ordinary user which side of each brush half 22, 24 is the side face 38, 42 that mates with the other brush half 24, 22, even without recognizing the significance of the projections 40 and recesses 44. The projections 40 and recesses 44 help to hold the two halves correctly aligned in the open configuration, and to stop the faces 38, 42 from sliding over each other.

As will be explained in more detail below, in some embodiments only one broad side of the casing 30, 32 of each brush half 22, 24 is used as the broad major face 46 that mates with the other brush half 24, 22 in the second configuration. That face 46 is generally flat and smooth. However, in this embodiment the head 26 is of constant thickness across its width, so the other broad side 48 of the casing 30, 32 is also flat and smooth. Optionally, therefore, the sides 46, 48 may be made different in appearance. For example, the other broad side 48 may be provided with decoration or information, for example, in the form of printed matter 72, that recognizably identifies it as the exposed side in the folded configuration. Where the two halves 22, 44 are not identical, the printed matter may also assist in ensuring that the user has one half 22 and one half 24, and is not trying to assemble two identical halves 22 or two identical halves 24. Alternatively, the brush 20 may be constructed so that either side 46, 48 of each half 22, 24 can be used as the broad major face that engages the other brush half in the second configuration.

The casings 30, 32 may be made of molded plastic material.

Figure 17:
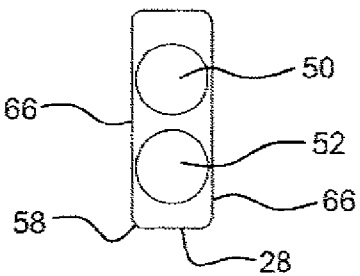
FIG. 17 is a side view of the holder shown in FIG. 16.
Figure 16:
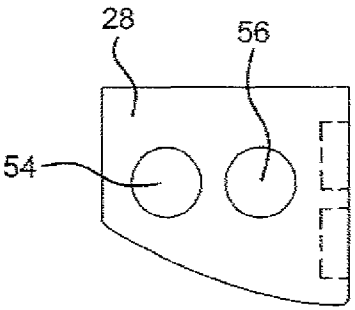
FIG. 16 is a front view of a magnet holder forming part of either of the half brushes shown in FIGS. 6 and 8.
Figure 18:
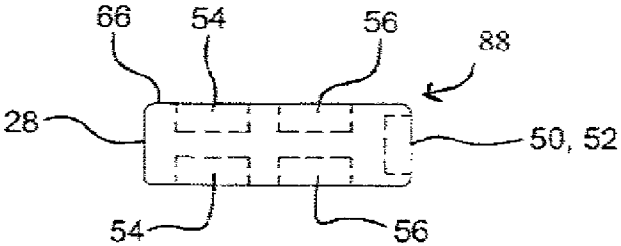
FIG. 18 is a top view of the holder shown in FIG. 16.
Figure 14:
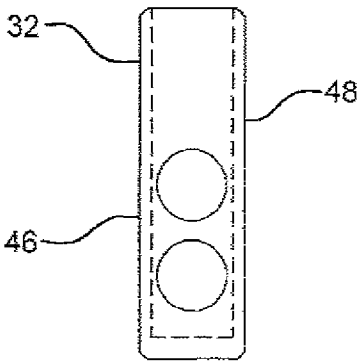
FIG. 14 is a side view of the casing shown in FIG. 10.

Referring now especially to FIGS. 16 through 18, the magnet holder 28 consists of a solid block of molded plastic material, with several magnetic elements 50, 52, 54, 56 embedded in it. The magnetic elements may be embedded in the course of the molding process, or the block may be molded or machined with recesses into which the magnetic elements 50, 52, 54, 56 are subsequently inserted.

In the embodiment, two magnetic elements 50, 52 are set into a face 58 of the block 28 that underlies the narrow side face 38, 42 of the casing 30, 32. The magnetic elements 50, 52 are one above the other on the vertical centerline of the faces 38, 42, 58. Each pair of magnets 50, 50 and 52, 52 on a pair of brush halves 22, 24 may consist of two permanent magnets or of one permanent magnet and a magnetically soft ferromagnetic counter-piece. For maximum strength, the permanent magnets may be aligned with one pole facing out through the side face 38, 42. Then, the two magnets of each pair 50, 50 or 52, 52 need to be oppositely oriented, and the two brush halves 22, 24 are different. As shown in FIGS. 1 through 18, the projections 40 and recesses 44 are also different between the two brush halves 22, 24.

As shown in FIGS. 1 through 18, the projections 40 and recesses 44 are similar in size, shape, and placement to the magnets 50, 52 and thus express visually the presence of the functional magnets 50, 52. However, other arrangements are of course possible.

Figure 19:
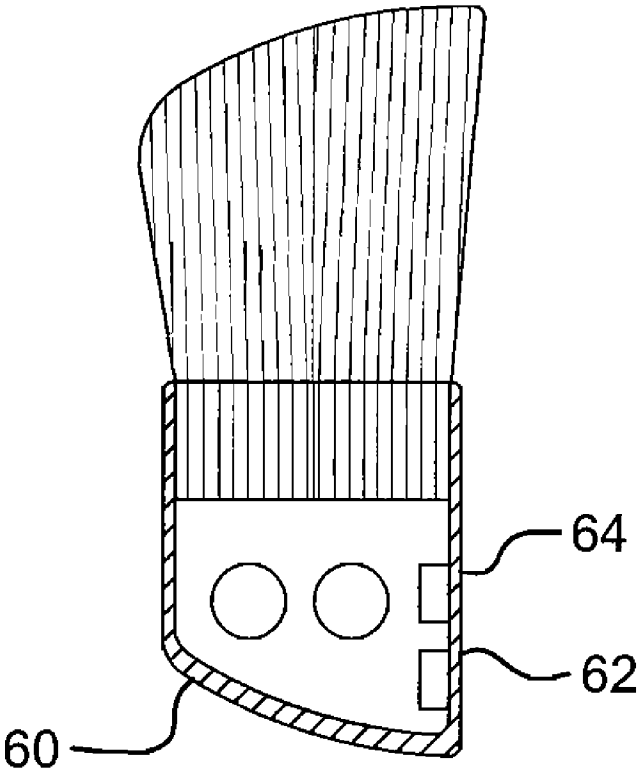
FIG. 19 is a view similar to FIG. 6 of a half-brush forming part of a second embodiment of a cosmetic brush.

Referring also to FIG. 19, in an alternative embodiment the projections 40 and recesses 44 may be omitted, and casings 60 with a flat narrow side face 62 may be used. It may then be preferred for the narrow side faces 62 to have a textured finish 64 that resists sliding of the faces 62 out of alignment. Identical brush halves 22, 24 are possible if the magnets 50, 52 are aligned with their poles facing towards the broad faces 46, 48. The magnets then engage side by side, not pole to pole, and a weaker connection may result.

In a further alternative, the magnets in brush half 22 may extend forward into the projections 40. That arrangement brings the magnets 50, 50 and 52, 52 closer together, and increases the strength of coupling from any given magnets. The visible metal of the magnets may also become a decorative feature. However, that alternative complicates manufacture because the assembled holder 28 and magnets 50, 52 can no longer be slid as a unit into the casing 30, 32.

In the embodiment shown in FIG. 18, two magnetic elements 54, 56 are set into each of two faces 66 of the block 88 that underlie the broad major faces 46, 48 of the casing 30, 32. The magnetic elements 54, 56 in each face 66 are side by side, roughly at the mid level of the block 28. Each pair of facing magnets 54, 54 and 56, 56 on a pair of brush halves 22, 24 may consist of two permanent magnets or of one permanent magnet and a magnetically soft ferromagnetic counter-piece. For compactness and aesthetic appearance, in the embodiments the second configuration has the two brush halves 22, 24 overlying each other with the sides 46 adjacent, so that the faces 66 of the brush halves 22, 24 that contain the active magnetic elements 54, 56 are mirror images of one another. For maximum strength, the magnetic elements 54, 56 may all be permanent magnets aligned with one pole facing out through the side face 46, 48. Then, the magnets of each pair 54, 54 or 56, 56 can be identically oriented, and the two brush halves 22, 24 can in this respect be the same.

In an alternative embodiment, where the faces 46, 48 of the brush halves 22, 24 are different, and it is intended that in the second or folded configuration the two brush halves shall always be assembled with a specific pair of broad faces 46 adjacent, the magnets 54, 56 may be inserted in only the side 66 of each holder 28 that underlies the faces 46. The assembled holders 28 of the two brush halves 22, 24 are then different. This alternative reduces the number of magnets, and therefore cost of materials, used in each brush, but increases the number of different sub-assemblies, and therefore may increase the cost of production.

Where this alternative is applied with magnet holders 28 that are shaped before the magnets are inserted, a single sort of magnet holder 28 may be produced, with recesses on both sides, and magnets 54, 56 inserted into the recesses on only one side of each holder 28. The remaining empty recesses do not impair the final product, because they are hidden within the casings 30, 32.

Figure 20:
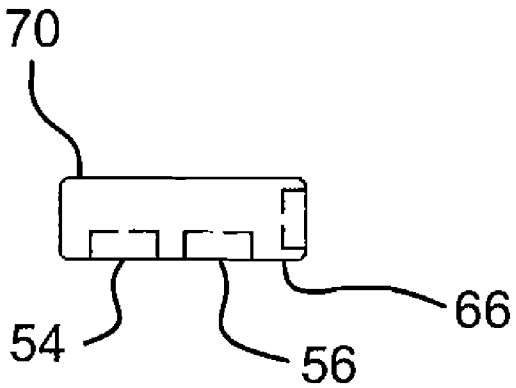
FIG. 20 is a view similar to FIG. 18 of a holder forming part of a third embodiment of a cosmetic brush.

Referring now also to FIG. 20, if only one magnetic element 54 and one magnetic element 56 is to be included in each holder, an alternative form of holder 70 may have recesses for the magnetic elements 54, 56 in only one side 66. This configuration may result from shaping a magnet holder 70 with recesses on only one side into which magnetic elements 54, 56 are subsequently inserted, or molding the holder block 70 onto only one magnetic element 54 and one magnetic element 56. The holders 70 may be made in mirror-image pairs or, in order to simplify manufacture, the holders 70 can be made identical. The magnetic elements 54, 56 then either extend through the whole thickness of the block 70, or are sufficiently strong to attract across the part of the thickness of the block 70 through which they do not extend. As was explained above, if all the assembled holders 70 are identical the magnetic elements 54, 56 should be permanent magnets. If two different sorts are produced for brush halves 22, 24, then one magnetic element of each pair 54, 54, and 56, 56 can be a magnetically soft counter-piece.

In use, the user is provided with a matched pair of brush halves 22, 24. To form a broad, thin half-moon brush 20 in the first configuration as shown in FIG. 1, the user aligns the brush halves 22, 24 so that the tips of the heads 26 form the desired half-moon shape, and places the narrow side faces 38, 42 or 62, 62 together. The projections 40, if present, seat in the recesses 44. The pairs of magnetic elements 50, 50 and 52, 52 then engage magnetically, both holding the two brush halves 22, 24 together and holding them in the correct relative position. Printed matter 72 on one or both of the broad faces 46, 48 may confirm the correct relative position. The user may then use the assembled "half-moon" brush to apply cosmetics.

To form a thicker but less broad brush 20 in the second or folded configuration, the user aligns the brush halves 22, 24 face to face, and places the broad major faces 46 together. The pairs of magnetic elements 54, 54 and 56, 56 then engage magnetically, both holding the two brush halves 22, 24 together and holding them in the correct relative position for the second configuration. The brush 20 in the second configuration may be used to apply cosmetics, or may be stored more compactly than in the first configuration. The more compact shape may simplify providing a suitable place for storage, especially in a makeup kit containing assigned compartments or holders for different brushes, applicators or cosmetic materials. The more compact shape may reduce the risk of damage in storage.

As an example of suitable dimensions for cosmetic brushes, the brush or applicator 20 may be around 40 mm (1½") high, measured at the highest point along the side 38, 42, of which half may be the visible height of the head 26, and half may be the height of the casing 30, 32. Each brush half 22, 24 may be around 16 mm (⅔") wide, giving the brush 20 in the first configuration of FIG. 1 a total width of around 32 mm (1¼"). Each brush half 22, 24 may be around 6 mm (¼") thick, which is also the thickness of the brush 20 in the first configuration of FIG. 1. The brush in the second configuration is thus around 16 mm wide and 12 mm thick. The walls 38, 42, 46, 48 of the casing 30, 32 may be around 0.6 mm (0.025") thick, taking into consideration both mechanical strength and the reduction in magnetic attraction as the space between the magnetic elements increases. The bottom wall and the outer side wall 48 of the casings may be the same thickness, for convenience of design, molding, and assembly. The four walls may be slightly tapered, for easier demolding, but it is preferred for any taper to be too slight to be apparent to an ordinary user. The bottom wall of the casing 30, 32 may be the same thickness or thicker. The magnet holder 28 is dimensioned to fit inside the bottom of casing 30 or 32 without rattling, and may leave about 6 mm (¼") of space in the top 34 of casing 30, 32 for mounting the bases 36 of the bristles or hairs of head 26. The magnetic elements 50, 52, 54, 56 may be circular, and around 4.1 mm (0.16") in diameter, and 1.6 mm (0.06") thick. The projections 40 may be around 0.3 mm (0.01") high, and the corresponding recesses 44 may be around 0.3 mm deep.

The disclosures of each patent, patent application and publication cited or described in this document are hereby incorporated herein by reference, in their entirety.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims and their equivalents.

For example, expressions of orientation such as "top" and "bottom" have been used with reference to the orientation of the brush 20 and brush halves 22, 24 as shown in various figures of the drawings. The brush may of course be held, stored, and used in any orientation.

Several possible variants in the arrangement of the magnetic elements 50, 52, 54, 56 have been noted above. Other variants are possible. For example, it is apparent from FIG. 16 that there is room for the magnets 54, 56 to be placed differently, or for the number of magnets to be different. If it is desired to use the brush 20 in combination with the stand described in commonly-assigned U.S. Patent Application No. 2007-0199575, then the magnets 54, 56 may be positioned appropriately for a specific stand.

The magnets shown in the drawings are circular, with their poles on the end faces. If it is desired for the polar direction of a magnet to lie parallel, rather than perpendicular, to the adjacent surface of casing 30, 32, then a different shape may give a better distribution of magnetic flux, and/or may assist in orienting the magnet correctly.

Although the second configuration shown in FIGS. 3 through 5 has been described as a "folded" configuration, the two brush halves 22, 24 are separate, and are typically separated and reassembled when changing between the first and second configurations. A hinge, which may be a living hinge, could be provided that allowed actual folding between the two configurations.

In FIGS. 1 through 18, projections 40 and recesses 44 are on narrow side faces 38, 42. Similar recesses could instead, or in addition, be provided on broad faces 46. However, if the second or folded configuration is used only for storage, such additional projections and recesses are usually not important, and they may make the brush 20 less comfortable to hold in the first or open configuration.

Although the brush 20 has been described as a "half-moon" brush, and shown in the drawings with a convex head 26, the outline of the tip edge of the head may be of any desired shape for a specific application. An applicator other than a brush, with a head 26 other than bristles, is also possible.

Although specific embodiments have been described, the skilled person will understand how features of different embodiments may be combined. For example, the various options for magnets 50, 52 may be chosen independently of the options for magnets 54, 56, or may be coordinated so that a single type of magnet can be used throughout. If it is desired for the two brush halves 22, 24 to be identical, then an appropriate combination of choices may be made.

What is claimed is:

1. A cosmetic applicator comprising two applicator parts, each having a head and a flat handle, wherein:

the handle of each part is similarly shaped as having a wide major face and a narrow side face, wherein the wide major face has one or more magnetic components positioned over at least one of its length or its width, and wherein the narrow side face has one or more magnetic components positioned along its length;

the two said applicator parts are arranged to be combinable in a first configuration with the two narrow side faces abutting and the heads side by side to form a single wide, flat head, and to be combinable in a second configuration with the two wide major faces abutting and the heads face to face to form a single flat head;

the magnetic components in each of said applicator parts cooperate with magnetic components in the other part to hold the applicator parts together in both the first and the second configurations;

at least one of the wide major faces and the narrow side faces comprises at least one relatively recessed portion, and the respective wide major face or narrow side face that abuts said at least one face comprises a relatively projecting portion that fits into said relatively recessed portion at an engaging location when the two parts are combined with those two faces abutting; and said engaging location being intermediate two of the corresponding cooperating magnetic components facilitating said abutting.

2. A cosmetic applicator according to claim 1, wherein at least one of the wide major faces and the narrow side faces comprises at least one recess including said recessed portion, and the respective wide major face or narrow side face that abuts said at least one face comprises a projection including said projecting portion that fits into the recess when the two parts are combined with those two faces abutting.

3. A cosmetic applicator according to claim 1, wherein the magnetic components are all permanent magnets.

4. A cosmetic applicator according to claim 1, wherein the magnetic components include at least one component of magnetically soft ferromagnetic material positioned to cooperate with a permanent magnet.

5. A cosmetic applicator according to claim 1, wherein said narrow face of each of said applicator parts is provided with two or more magnetic components spaced apart along the length of said narrow side face.

6. A cosmetic applicator according to claim 1, wherein said wide major face of each said applicator part is provided with two or more magnetic components spaced apart over at least one of a length and a width of said wide major face.

7. A cosmetic applicator according to claim 1, wherein at least one said magnetic component is a permanent magnet oriented with one pole facing out through an associated face of the respective applicator part.

8. A cosmetic applicator according to claim 1, wherein in said first configuration the wide, flat head is longer, in a direction towards and away from the handle, at a central portion where the two parts abut than at edge portions away from where the two parts abut.

9. A cosmetic applicator according to claim 8, wherein in said first configuration a free edge of the head facing away from the handle is curved and convex.

10. A cosmetic applicator according to claim 1, wherein the head comprises bristles forming a brush.

* * * * *